US008735708B1

(12) United States Patent
Joyce et al.

(10) Patent No.: US 8,735,708 B1
(45) Date of Patent: May 27, 2014

(54) SYSTEM AND METHOD FOR SYNCHRONIZING TAG HISTORY

(71) Applicants: Paul Joyce, Moutain View, CA (US); Dominik Roblek, Zürich (CH); Owen Daniel Otto, Mountain View, CA (US); Matthew Sharifi, Zürich (CH); Annie Chen, Zürich (CH); Lars Fabian Krüger, Zürich (CH)

(72) Inventors: Paul Joyce, Moutain View, CA (US); Dominik Roblek, Zürich (CH); Owen Daniel Otto, Mountain View, CA (US); Matthew Sharifi, Zürich (CH); Annie Chen, Zürich (CH); Lars Fabian Krüger, Zürich (CH)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/770,661

(22) Filed: Feb. 19, 2013

Related U.S. Application Data

(60) Provisional application No. 61/719,448, filed on Oct. 28, 2012.

(51) Int. Cl.
*G10H 1/00* (2006.01)

(52) U.S. Cl.
USPC ..... 84/600; 84/601; 700/94

(58) Field of Classification Search
USPC ..... 84/600–602; 700/94
See application file for complete search history.

(56) References Cited

U.S. PATENT DOCUMENTS

| | | | | |
|---|---|---|---|---|
| 6,990,453 | B2 | 1/2006 | Wang et al. | |
| 7,761,400 | B2 | 7/2010 | Reimer | |
| 8,059,646 | B2 | 11/2011 | Svendsen et al. | |
| 8,155,582 | B2 * | 4/2012 | Rhoads et al. | 455/3.06 |
| 8,422,490 | B2 * | 4/2013 | Svendsen et al. | 370/386 |
| 2003/0210148 | A1 * | 11/2003 | Imasaki et al. | 340/573.1 |
| 2010/0030775 | A1 * | 2/2010 | Mohajer et al. | 707/5 |
| 2010/0150395 | A1 * | 6/2010 | Davis et al. | 382/100 |
| 2012/0030368 | A1 * | 2/2012 | John et al. | 709/231 |
| 2012/0036156 | A1 * | 2/2012 | Mohajer et al. | 707/772 |
| 2012/0072845 | A1 * | 3/2012 | John et al. | 715/738 |
| 2012/0123831 | A1 | 5/2012 | King et al. | |
| 2012/0158725 | A1 * | 6/2012 | Molloy et al. | 707/737 |
| 2012/0209896 | A1 * | 8/2012 | Raymond | 707/827 |
| 2012/0232683 | A1 * | 9/2012 | Master et al. | 700/94 |
| 2013/0019262 | A1 * | 1/2013 | Bhatia et al. | 725/34 |

* cited by examiner

*Primary Examiner* — David S. Warren
(74) *Attorney, Agent, or Firm* — Martine Penilla Group, LLP

(57) ABSTRACT

Systems and methods for music recognition and/or tag history synchronization are described. The system includes, for example, a first device, a second device and a server. The first device is configured to record music from a surrounding environment. The first device wirelessly sends the recorded music to the server for identification. The server is configured to identify the recorded music and to generate a tag corresponding to the identified music. The first tag history is updated to include the tag which includes information corresponding to the identified music. The first device and the second device are registered with the server as part of a particular user account. The server is configured to synchronize a second tag history stored in the second device with the updated first tag history.

22 Claims, 4 Drawing Sheets

SYSTEM AND METHOD FOR SYNCHRONIZING TAG HISTORY

CROSS-REFERENCE TO RELATED APPLICATION/INCORPORATION BY REFERENCE

This patent application makes reference to, claims priority to and claims benefit from U.S. Provisional Application Ser. No. 61/719,448 filed on Oct. 28, 2012.

The above stated application is hereby incorporated herein by reference in its entirety.

BACKGROUND

When a user hears music, the user typically can have difficulty in identifying the music, especially if there are no lyrics or words in the music. Furthermore, even if the music can be identified at the time, the user might later forget about the identified music, which the user might have wanted to purchase online when the user got home, for example.

Further limitations and disadvantages of conventional and traditional approaches will become apparent to one of skill in the art through the comparison of such systems with some aspects of some embodiments according to the present disclosure as set forth in the remainder of the present application with reference to the drawings.

BRIEF SUMMARY

Aspects of the disclosure relate to methods and systems for identifying audio and for synchronizing tag histories related to the identified audio.

An example embodiment provides a system that includes, for example, a server. The server is configured to receive recorded music for identification. The server is also configured to identify the recorded music and to generate a tag corresponding to the identified music. The server is also configured to update a first tag history stored at the server to include the tag that includes information corresponding to the identified music. The server is also configured to synchronize a second tag history with the updated tag history.

An example embodiment provides a method that includes, for example, one or more of the following: receiving, by a server, music sent by a first device; identifying, by the server, the received music by comparing the received music with reference music files; generating, by the server, a tag in a first tag history, wherein the tag includes information about the identified music, wherein the first tag history includes a plurality of tags and corresponds to a particular user account; and synchronizing, by the server, the first tag history with a second tag history stored in the first device.

An example embodiment provides a server that includes, for example, a memory and a processor that is operatively coupled to the memory. The processor is configured to receive music sent by a first device; identify the received music by comparing the received music with reference music files; generate a tag in a first tag history, wherein the tag includes information about the identified music, wherein the first tag history includes a plurality of tags and corresponds to a particular user account; and synchronize the first tag history with a second tag history stored in the first device.

These and other advantages, aspects and novel features of the present disclosure, as well as details of an illustrated embodiment thereof, will be more fully understood from the following description and drawings.

DETAILED DESCRIPTION

Aspects of the disclosure relate to methods and systems for identifying audio and/or for synchronizing tag histories related to the identified audio.

Figure 1:
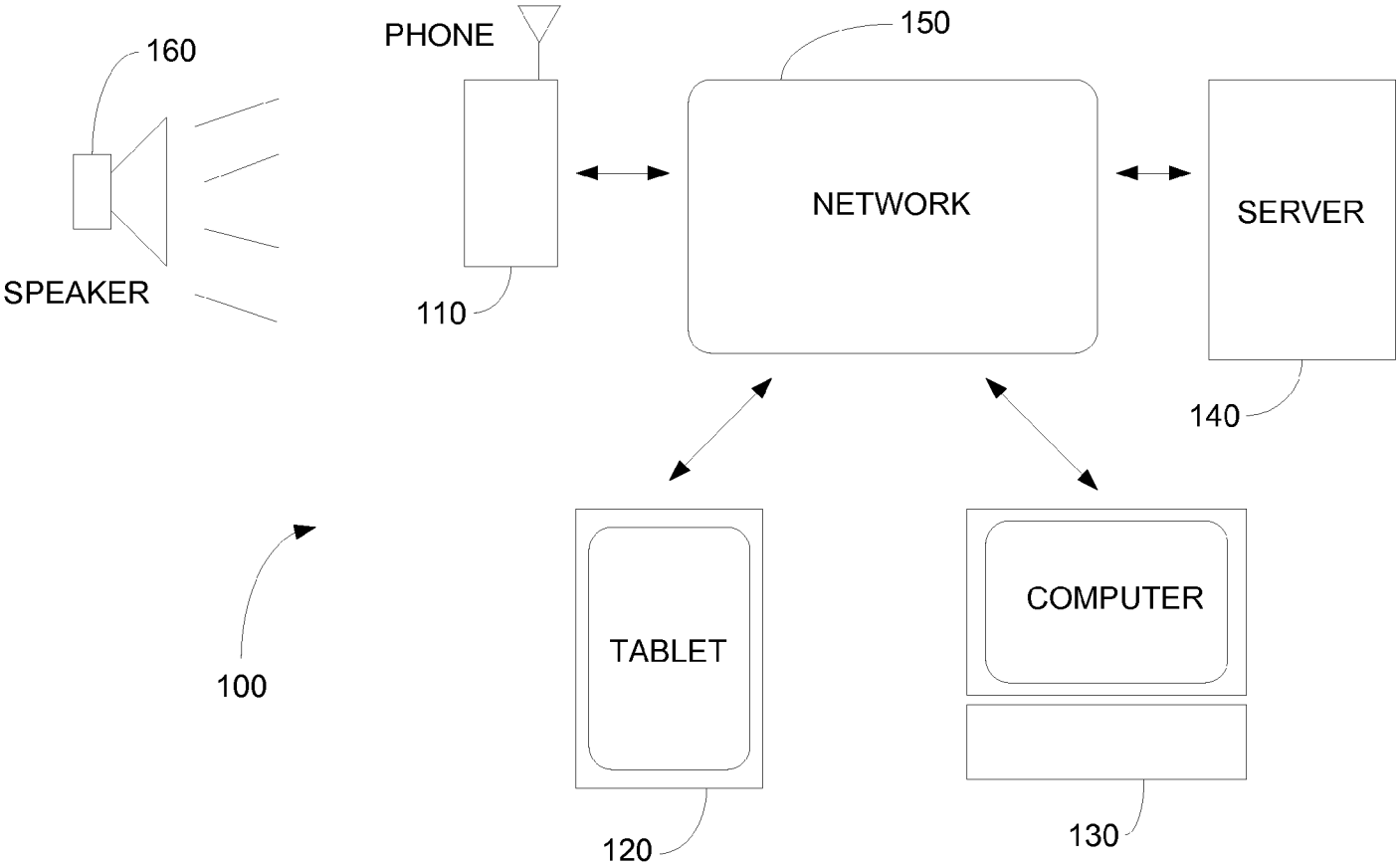
FIG. 1 illustrates an example embodiment of a system for identifying audio and/or for synchronizing tag histories.

FIG. 1 illustrates a system 100 for identifying audio and/or for synchronizing tag histories related to the identified audio. The system 100 may include, for example, a wireless communication device 110, a computing tablet 120, a computer 130, a server 140 and a network 150. The wireless communication device 110, the computing tablet 120, the computer 130 are coupled to the server 140. In an example embodiment, the network 150 facilitates wireless and/or wired communication (e.g., two-way communication) between the wireless communication device 110, the computing tablet 120, the computer 130 and the server 140. The wireless communication device 110, the computing tablet 120 and the computer 130 can communicate with each other directly or indirectly in a wired or wireless manner.

In an example embodiment, the wireless communication device 110 can be, for example, a cellular device (e.g., a smart phone) or other type of handheld wireless device. The wireless communication device 110 can communicate with the server 140 via the network 150, which can include a telecommunication network. Thus, in relation to the telecommunication network, the wireless communication device 110 can wirelessly communicate with a base station which, in turn, communicates with a base station controller which, in turn, communicates with a central office (e.g., a mobile telephone switching office) which, in turn, communicates with the server 140 via the Internet and/or other network (e.g., a private network), for example, in accordance with an example embodiment.

In another example embodiment, the wireless communication device 110 can communicate with the server 140 via an access point (e.g., a wireless local access network access point (WLAN AP), an 802.11 access point, a Bluetooth access point, etc.). The wireless communication device 110 can be coupled to the access point via wireless or wired link. The access point can provide access to the rest of the network 150 including, for example, the Internet to communicate with the server 140.

In operation, an audio sound is produced in the surrounding environment of the wireless communication device 110. The audio sound can be produced, for example, by one or more speakers 160. In an example embodiment, the speaker 160 can reproduce music including voice, for example, in a live performance or from a recording. In another example embodiment, the speaker 160 can reproduce music from a radio or satellite station. In yet another example embodiment, the audio sound received by the wireless communication device 110 is directly from the instruments and/or the person. Although illustrated herein at times as music or a song, the audio sound need not be so limited. The audio sound can also be a person speaking, reading a book aloud, sounds from a movie, video or television program, etc.

The wireless communication device 110 can be activated to a particular mode in which the wireless communication device 110 facilitates the identification of the music received from the speakers 160. The mode can be activated by running an application on the wireless communication device 110. During the running of the application, the application may request a user to log onto the system for identifying music and/or for synchronizing tag histories related to the identified music. Log on can be successful, for example, if the user previously registered the wireless communication device 110 with the identification and synchronization system 100 (e.g., with the server 140 or with an authentication server). Authentication can also be achieved automatically by determining whether the wireless communication device 110 is registered with the server 140 via identification information (e.g., a unique identification number, a mobile identification number, a subscriber identification number, an Internet protocol address, an Ethernet address, a media access control address, a virtual address, a phone number, etc.).

The music produced by the speakers 160 is received by the wireless communication device 110 via a microphone of the wireless communication device 110, for example. The wireless communication device 110 records and transmits the received music to the server 140. In an example embodiment, a portion of the received music is transmitted to the server 140. In another embodiment, data, information, features and/or characteristics based on or derived from the received music are sent to the server 140. As noted above, this can be achieved, for example, by wirelessly transmitting the recorded music through a telecommunications network to the server 140. In one example embodiment, the wireless communication device 110 finishes recording the received music before sending the recorded music to the server 140. In another example embodiment, while the wireless communication device 110 records the received music, the wireless communication device 110 transmits the recorded music at particular intervals. Thus, for example, the wireless communication device 110, while recording the received music, can transmit every three seconds the music recorded in the approximately three second intervals. In another example embodiment, the wireless communication device 110 streams the music to the server 140 as the wireless communication device 110 receives the music. In yet another example embodiment, the recording and the transmitting of the music need not be concurrent.

The music is received at the server 140. The server 140 compares the music with other music files stored at the server 140 or at one or more storage devices to which the server 140 has access. In an example embodiment, the server 140 compares the music against an index of reference files and computes a result that indicates a best match. Accordingly, the server 140 is able to match and to identify the music received from the wireless communication device 110.

Figure 2:
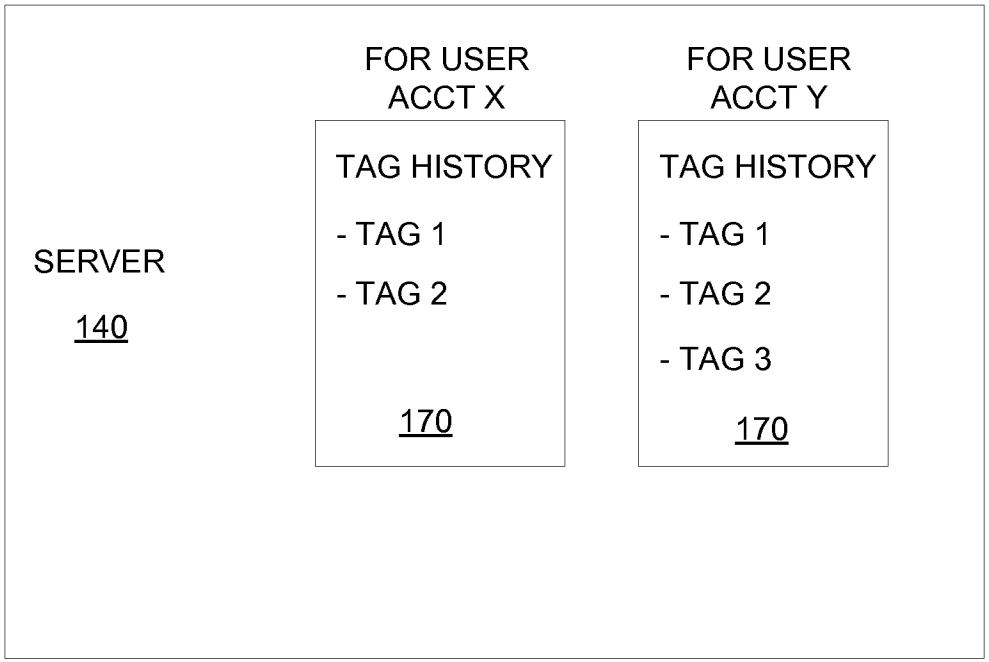
FIG. 2 illustrates an example embodiment of a server.

Referring to FIG. 2, an example embodiment of the server 140 is illustrated on which resides a tag history. The tag history 170 can be stored in a memory or a storage device of the server 140 or in a memory or a storage device to which the server 140 has access. In an example embodiment, the tag history 170 can include a list of music that was previously recorded and transmitted by a device (e.g., the wireless communication device 110, the computing tablet 120 and/or the computer 130) of the system 100. In an example embodiment, the tag history 170 is kept for all the devices registered under a particular user account. Thus, user installs the application on each of the devices that the user wants to register as part of the identification and synchronization system 100. The user registers each device, which then can update or synchronize with the tag history for the particular user account stored in the server 140. In one embodiment, registration might include logging onto the particular user account or automatically authenticating the user or the device.

Once the music is identified, the server 140 updates the tag history 170 stored on the server 140. In one example embodiment, the tag history 170 is a listing or a table of listings in which an entry, also known as a tag, is made after the server 140 matches and identifies the music sent by the wireless communication device 110. The tag can include, for example, one or more of the following: a date (e.g., when music received or transmitted by the wireless communication device 110, or when the server 140 identifies the music transmitted by the wireless communication device 110), an artist (e.g., singer, composer, band, etc.), a title, etc. In an example embodiment, the tag can include a link to a website to facilitate online purchasing and downloading of the particular music identified in the tag history 170.

The updated tag history 170 is then sent to each of the devices (e.g., the wireless communication device 110, the computing tablet 120 and/or the computer 130) of the system 100. In an example embodiment, the updated tag history 170 is stored locally in each of the devices.

Thus, the updated tag history 170 can be displayed on any of the devices (e.g., the wireless communication device 110, the computing tablet 120 and/or the computer 130) of the system 100. On the wireless communication device 110, for example, after activating the application to identify the music produced in the environment surrounding the wireless communication device 110, the user can display the updated tag history 170 stored in the wireless communication device 110. If the user wants to purchase the identified music, for example, the user can use the link in the tag to browse an online music store, for example.

If the user wants to purchase the identified music at home on the computer 130, for example, instead on the wireless communication device 110, the computer 130 can display an updated tag history 170 that includes the tag corresponding to the identified music that was previously recorded by the wireless communication device 110 and transmitted to the server 140 for identification. As noted above, the computer 130 has the updated tag history 170 because the computer 130 received the updated tag history 170 from the server 140. The tag history 170 displayed by the computer 130 includes the tag corresponding to the music recorded by the wireless communication device and the tag includes the link to an online music store, for example, from which the user can purchase and download the identified music onto the computer 130, for example, or any of the other devices of the system 100.

In addition, to adding tags to the tag history through the music identification process, any device (e.g., the wireless communication device 110, the computing tablet 120 and/or the computer 130) of the system 100 can directly update the tag history 170. For example, any of the devices of the system 100 can add, remove and/or modify tags. Local changes to the tag history 170 are synchronized with the local tag histories 170 stored in the devices of the system 100 so that each device has the same tag history 170. In an example embodiment, the entire updated tag history is transmitted to each device of the system 100 to synchronize all of the tag histories 170. In another example embodiment, only the changes to or a portion of the tag history 170 is transmitted to each device of the system 100 so that each device can modify the locally stored tag history 170 to synchronize all of the tag histories 170.

Figure 3:
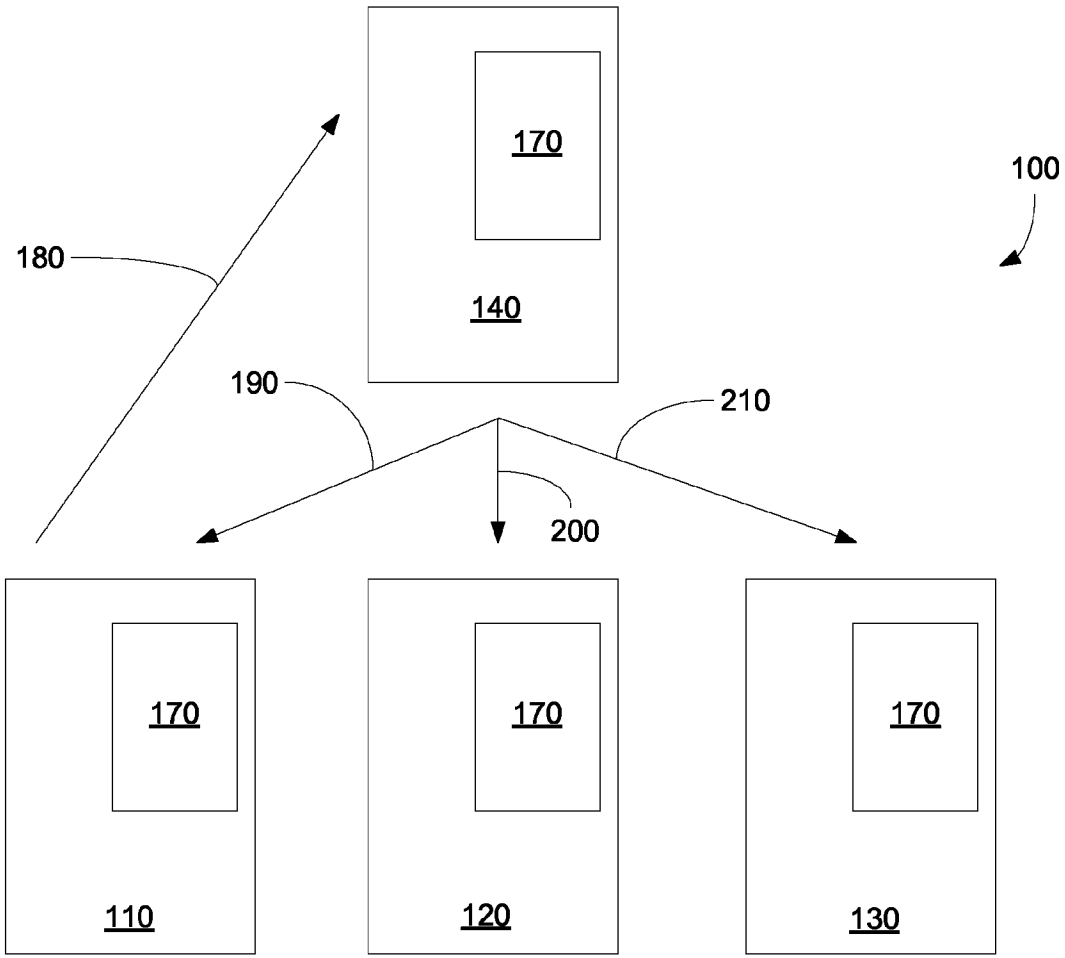
FIG. 3 illustrates an example embodiment of the system for identifying audio and/or for synchronizing tag histories.
Figure 4:
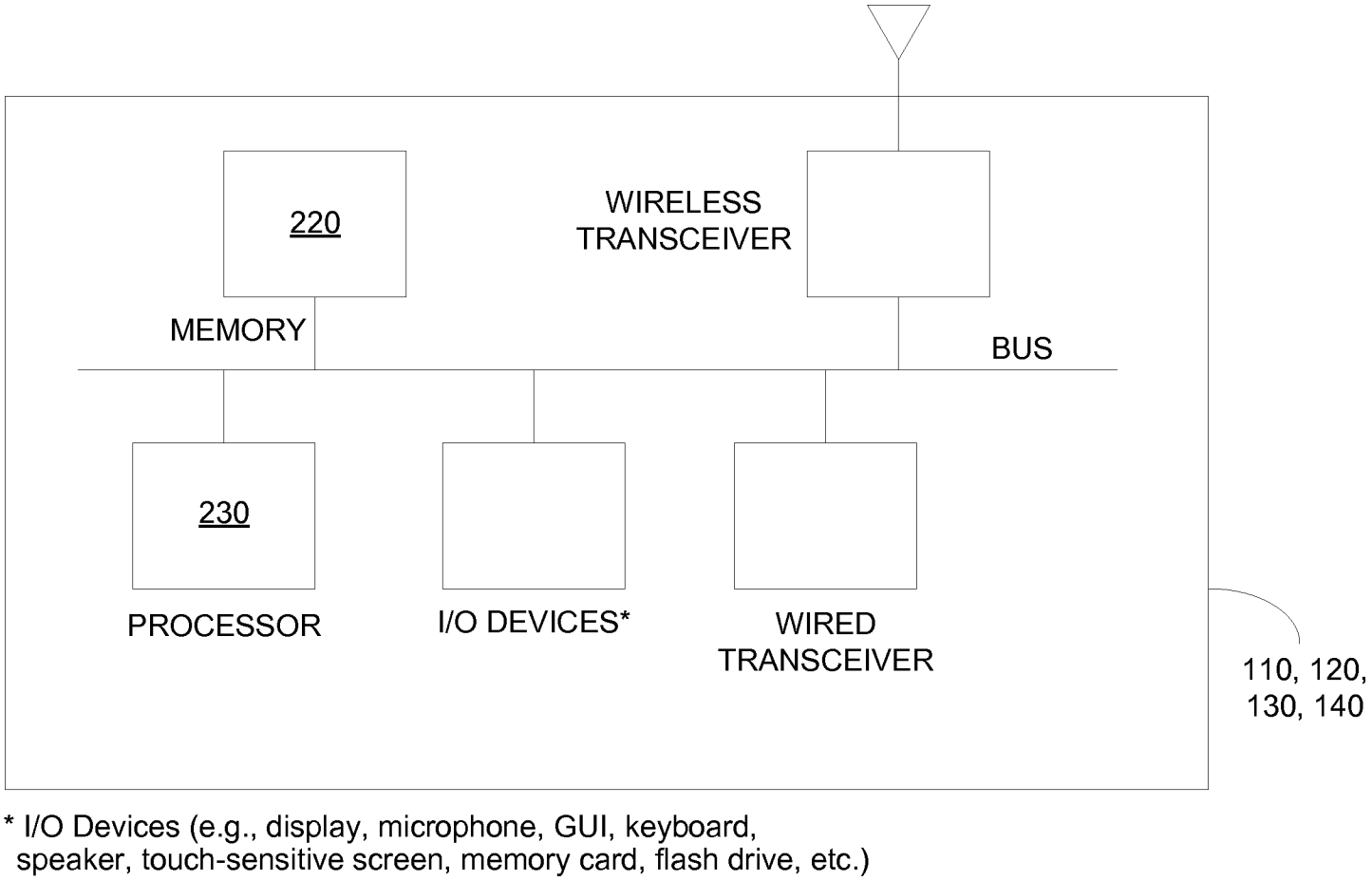
FIG. 4 illustrates an example embodiment of a device or a server.

FIG. 3 illustrates an example embodiment of the synchronization of the tag histories 170. In the music recognition and tag history synchronization system 100, each device 110, 120, 130 (e.g., the wireless communication device 110, the computing tablet 120, and the computer 130) has a music recognition and tag history synchronization application stored thereon. In an example embodiment, the application (e.g., instructions and/or code) can be stored in a respective memory 220 (e.g., a non-transitory computer readable medium) and run by a corresponding processor 230 in the device 110, 120, 130 or the server 140 as illustrated in FIG. 4.

Although illustrated with respect to a tag history corresponding to a particular user account, an example embodiment can provide that the server 140 stores a plurality of tag histories in which each tag history corresponds to a respective and different user account.

Using the installed application, each device 110, 120, 130 can be registered with the server 140 and/or the system 100 under a particular user account. To actively participate in the system 100, the device 110, 120, 130 may employ a log-on process or other authentication procedure (e.g., an automatic authentication based on available identification information about the device 110, 120, 130 or the user).

Tag histories 170 are stored locally in the corresponding devices 110, 120, 130 and the server 140. If a change to the tag history 170 is made at the server 140, then the server 140 sends the updated tag history 170 or the changes to the tag history 170 to each of the devices 110, 120, 130 as indicated by flow paths 190, 200, 210 in FIG. 3. Thus, each device 110, 120, 130 that is registered under a particular user account receives the updated tag history 170 or the changes to the tag history 170 corresponding to the particular user account. The devices 110, 120, 130 store the updated tag history 170 or implement the changes to the tag history 170 and then store the updated tag history 170. The transmission of the updated tag history 170 or the changes to the tag history 170 by the server 140 can be periodic or aperiodic (e.g., event-activated). If the server 140 is unsuccessful in sending the transmission to a particular device 110, 120, 130, for example, if the server 140 did not receive an acknowledgement from the particular device 110, 120, 130, then the server 140 can, for example, retransmit; wait and then retransmit; or store the changes until the server 140 is notified that the particular device 110, 120, 130 is again in communication with the server 140 and then retransmit.

Devices 110, 120, 130 that were not in communication with the server 140 at the time of a synchronization of the tag histories 170 can notify the server 140 when it is again in communication with the server 140 and request any changes to the tag histories 170 that the device 110, 120, 130 might have missed. In an example embodiment, the device 110, 120, 130 might report a time stamp to the server 140 corresponding to the last update to the tag history 170 stored in the device 110, 120, 130. The server 140 can then use the received time stamp to determine which updates to the tag history 170, which are time-stamped, to send to the device 110, 120, 130.

In another example embodiment, the devices 110, 120, 130 can transmit updated tag histories 170 or changes to the tag histories 170 to each other instead of or in addition to receiving the tag histories from the server 140. Thus, a particular device 110, 120, 130 might be out of communication with the sever 140, but might be in communication with another device 110, 120, 130 that has a more recent update to the tag history. Thus, the particular device 110, 120, 130 can request and receive the latest tag history 170 from the other device 110, 120, 130. In an example embodiment, tag histories 170 can be synchronized by sending updated tag histories 170 or changes to the tag histories 170 via email between the devices 110, 120, 130, 140.

If a user manually adds or deletes tags from the tag history 170 while logged on to a particular device 110, 120, 130, the device 110, 120, 130 notifies the server 140 of the change to the tag history 170 as indicated by flow path 180 in FIG. 3. The server 140 saves the changes to the tag history 170 and then transmits the changes to the devices 110, 120, 130.

If a user records music being played in the environment surrounding the device 110, the device 110 transmits the recorded music or a derivation thereof to the server 140 as indicated by the flow path 180 in FIG. 3. After identifying the music from the device 110, the server 140 updates the tag history 170 stored at the server 140 or at a memory accessible by the server 140. The server 140 then transmits the updated tag history 170 or the changes to the tag history 170 to the devices 110, 120, 130.

In an example embodiment, music recorded by one device 110, 120, 130 can be displayed in the tag history 170 of another device 110, 120, 130. The tags in the tag history 170 displayed on the device 110, 120, 130 can provide a link to facilitate listening, viewing, purchasing and/or downloading of the identified music.

Although illustrated in one or more example embodiments as music reproduced in the environment surrounding a device 110, 120, 130 and received, for example, via a microphone of the device 110, 120, 130, other example embodiments receive the music in other ways. In another example embodiment, the music is being played by a sound system, but not out loud. Instead, a wired or wireless connection provides the music to an input interface (e.g., a headphone jack) of the device 110. In yet another example embodiment, the music is not played around the device 110, but is instead merely stored in the device 110 (e.g., downloaded to the device 110). In yet another example embodiment, the music is sent to the device 110 as a file (e.g., a file as part of an attachment to an e-mail).

In sum, systems and methods for music recognition and tag history synchronization are provided. A first wireless device records music using its microphone and transmits the music to a server. The server identifies the music and generates a tag that is stored in a tag history. The tag is an entry in the tag history that corresponds to information relating to the identified music. The tag history is list of previous tags (e.g., previously identified music) and corresponds to a particular user account. The tag history is updated and stored in the server and in all of the devices registered under the particular device including the first wireless device. The tag history corresponding to the particular user account can be displayed on any of the registered devices and includes tags which can be used to facilitate the playing, purchasing and/or downloading of the identified music.

While the present method and apparatus has been described with reference to certain embodiments, it will be understood by those skilled in the art that various changes may be made and equivalents may be substituted without departing from the scope of the present method and apparatus. In addition, many modifications may be made to adapt a particular situation or material to the teachings of the present disclosure without departing from its scope. Therefore, it is intended that the present method and apparatus not be limited to the particular embodiment disclosed, but that the present method and apparatus will include all embodiments falling within the scope of the appended claims.

What is claimed is:

1. A system, comprising:

a server configured to receive recorded music for identification, wherein the server is configured to identify the recorded music and to generate a tag corresponding to the identified music, wherein the server is configured to update a first tag history stored at the server, for a particular user account, to include the tag that includes information corresponding to the identified music, and wherein the server is configured to synchronize a second tag history with the updated first tag history, the second tag history being for the particular user account.

2. The system according to claim 1, comprising:

a first device that is in communication with the server, wherein the first device is configured to record music from a surrounding environment, wherein the server receives the recorded music for identification from the first device, and wherein the server is configured to synchronize the second tag history stored in the first device with the updated tag history.

3. The system according to claim 2, wherein the first device wirelessly sends the recorded music to the server for identification.

4. The system according to claim 2, comprising:

a second device that is in communication with the server, wherein the first device and the second device are registered with the server under the particular user account, wherein the server is configured to synchronize a third tag history of the particular user account stored in the second device with the updated first tag history.

5. The system according to claim 1, wherein the server compares the recorded music with reference music files.

6. The system according to claim 2, wherein the first device streams portions of the recorded music to the server as the first device records the music.

7. The system according to claim 4, wherein the second device can cause a particular tag in the first tag history to be added or removed.

8. The system according to claim 4, wherein the second device updates the third tag history, wherein the second device sends the updated third tag history to the server, wherein the server synchronizes the first tag history with the updated third tag history, and wherein the server synchronizes the second tag history with the latest updated first tag history.

9. The system according to claim 4, wherein the first tag history includes tags generated by music recorded at the first device and at the second device for identification at the server.

10. The system according to claim 2, wherein the first device records the music using a microphone of the first device.

11. The system according to claim 4, wherein the second device facilitates a purchase of the identified music that was initially recorded by the first device.

12. The system according to claim 2, wherein the recorded music includes live music.

13. The system according to claim 2, wherein the recorded music includes singing.

14. The system according to claim 2, wherein the first device records the music from the surrounding environment using a microphone that is part of the first device.

15. The system according to claim 4, wherein the first device is a cellular phone, and wherein the second device is a computer.

16. A method, comprising:

receiving, by a server, music sent by a first device;

identifying, by the server, the received music by comparing the received music with reference music files;

generating, by the server, a tag in a first tag history, wherein the tag includes information about the identified music, wherein the first tag history includes a plurality of tags and corresponds to a particular user account; and synchronizing, by the server, the first tag history with a second tag history stored in the first device.

17. The method according to claim 16, comprising:

registering, by the server, the first device and a second device under the particular user account; and synchronizing, by the server, the first tag history with a third tag history stored in a second device.

18. The method according to claim 16, comprising:

displaying the second tag history on a display of the first device;

modifying the second tag history;

sending, by the first device, the modification of the second tag history to the server;

synchronizing, by the server, the first tag history in view of the modification of the second tag history; and synchronizing the updated first tag history with a third tag history stored in a second device, wherein the first device and the second device are registered under the particular user account.

19. A server, comprising:

a memory; and a processor operatively coupled to the memory, wherein the processor is configured to receive music sent by a first device;

identify the received music by comparing the received music with reference music files;

generate a tag in a first tag history, wherein the tag includes information about the identified music, wherein the first tag history includes a plurality of tags and corresponds to a particular user account; and synchronize the first tag history with a second tag history stored in the first device.

20. The server according to claim 19, wherein the memory stores the first tag history corresponding to the particular user account and a second tag history corresponding to another user account.

21. The server according to claim 19, wherein the first tag history reflects tags that are caused to be generated by a plurality of devices that are registered with the server under the particular user account.

22. The server according to claim 19, wherein the processor is configured to synchronize the first tag history with a third tag history stored in a second device, wherein the first device and the second device are registered with the server under the particular user account.

* * * * *